US009756993B2

(12) United States Patent
Hagleitner

(10) Patent No.: US 9,756,993 B2
(45) Date of Patent: Sep. 12, 2017

(54) SUPPORT BAR FOR A DISPENSER AND DISPENSING SYSTEM

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 14 days.

(21) Appl. No.: 14/464,891

(22) Filed: Aug. 21, 2014

(65) Prior Publication Data

US 2014/0353418 A1 Dec. 4, 2014

Related U.S. Application Data

(63) Continuation of application No. PCT/AT2013/000032, filed on Feb. 20, 2013.

(30) Foreign Application Priority Data

Feb. 21, 2012 (AT) ..... A 218/2012

(51) Int. Cl.
*B65H 16/06* (2006.01)
*A47K 10/38* (2006.01)

(52) U.S. Cl.
CPC ..... *A47K 10/38* (2013.01); *A47K 10/3845* (2013.01)

(58) Field of Classification Search
CPC ..... A47K 10/24; A47K 10/32; A47K 10/38; A47K 10/3687; A47K 10/3836; A47K 2010/3681; B65H 16/06; B65H 49/322; B65H 49/325
USPC ..... 242/599, 599.3, 599.4, 598, 598.3
See application file for complete search history.

(56) References Cited

U.S. PATENT DOCUMENTS

| | | | | |
|---|---|---|---|---|
| 3,258,216 | A | 6/1966 | Wren | |
| 5,370,336 | A * | 12/1994 | Whittington | A47K 10/3836 242/560.2 |
| 5,597,135 | A | 1/1997 | Vandersteene | |
| 5,676,331 | A * | 10/1997 | Weber | A47K 10/38 242/560 |
| 6,082,664 | A | 7/2000 | Phelps et al. | |
| 7,431,236 | B2 | 10/2008 | Larsson | |
| 8,061,645 | B2 | 11/2011 | Granger | |
| 8,511,600 | B2 * | 8/2013 | Formon | A47K 10/3687 242/597.6 |
| 2001/0006202 | A1 | 7/2001 | Inana et al. | |
| 2008/0121750 | A1 | 5/2008 | Hagleitner | |
| 2014/0361117 | A1 | 12/2014 | Hagleitner | |

FOREIGN PATENT DOCUMENTS

| | | |
|---|---|---|
| CL | 200002543 | 8/2001 |
| CL | 200100968 | 3/2002 |
| CL | 200301839 | 7/2004 |
| CL | 200503474 | 7/2006 |

(Continued)

*Primary Examiner* — William A Rivera

(74) *Attorney, Agent, or Firm* — Laurence A. Greenberg; Werner H. Stemer; Ralph E. Locher

(57) ABSTRACT

A support bar for a material web wound onto a roll. The support bar has, on each end, a bearing journal which is arranged on the longitudinal axis thereof. At least one of the two bearing journals is provided with a fitting surface which is not designed as a rotational surface and is rotatably arranged on the support bar. The bearing journal can be inserted into a guide of a dispenser. The guide is continuous from the insertion position to the dispensing position.

4 Claims, 2 Drawing Sheets

(56) References Cited

FOREIGN PATENT DOCUMENTS

| | | | |
|---|---|---|---|
| CL | 200602436 | | 7/2007 |
| CL | 201402214 | | 1/2015 |
| CN | 1953920 | A | 4/2007 |
| CN | 101557746 | A | 10/2009 |
| CN | 201375472 | Y | 1/2010 |
| DE | 2000374 | A1 | 7/1971 |
| EP | 1927308 | A1 | 6/2008 |
| WO | 9926521 | A1 | 6/1999 |

* cited by examiner

Fig. 1
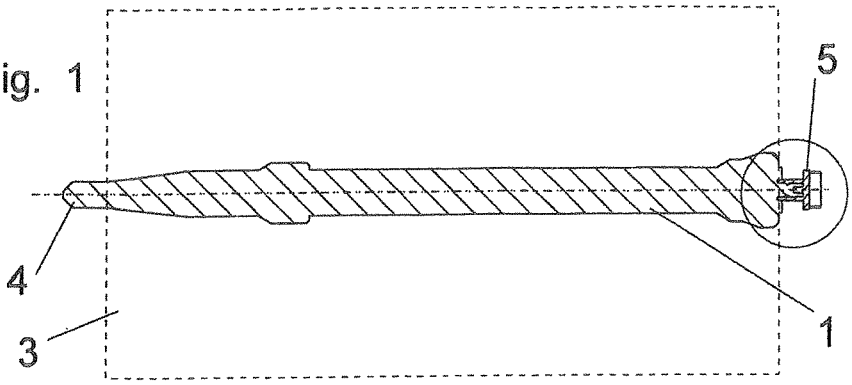
Fig. 2
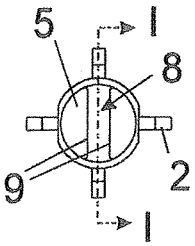
Fig. 3
Fig. 4
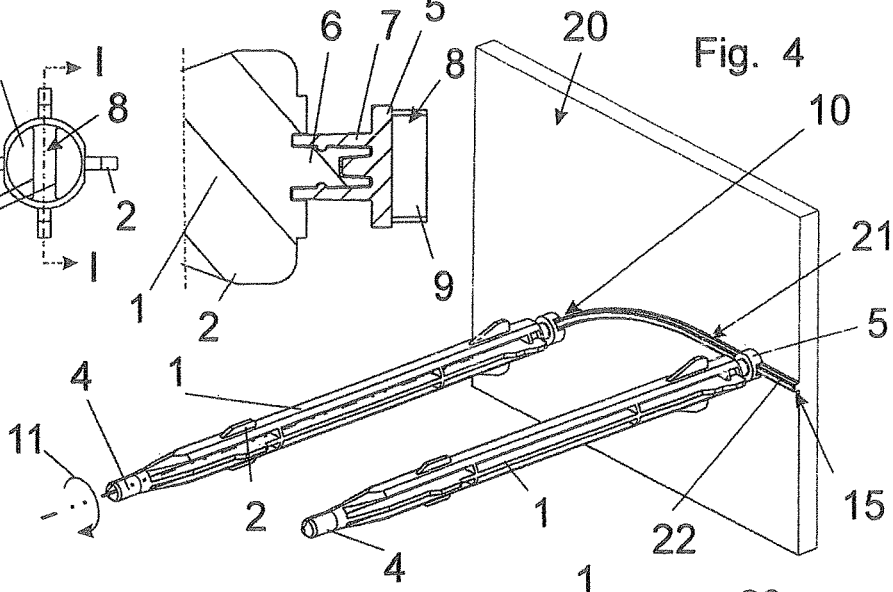
Fig. 5
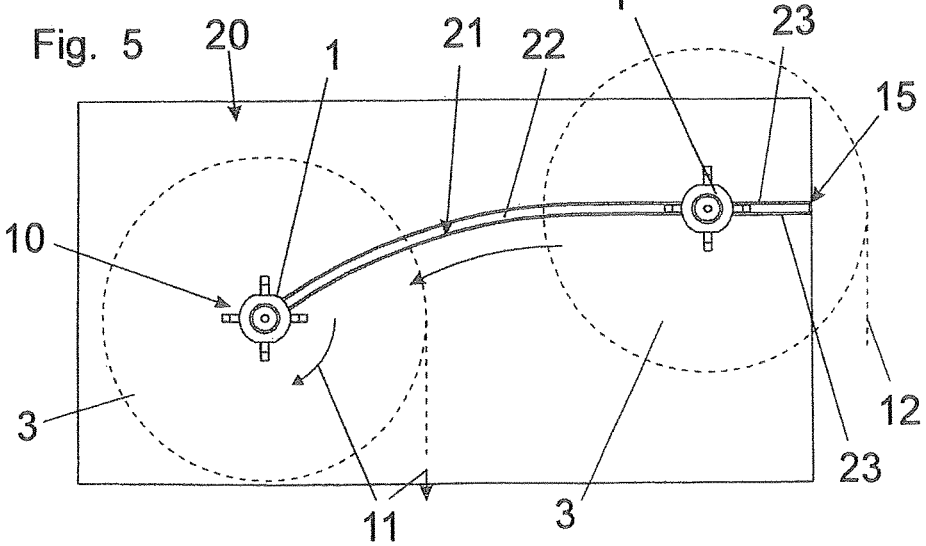

SUPPORT BAR FOR A DISPENSER AND DISPENSING SYSTEM

CROSS-REFERENCE TO RELATED APPLICATION

This application is a continuation, under 35 U.S.C. §120, of copending international application PCT/AT2013/000032, filed Feb. 20, 2013, which designated the United States; this application also claims the priority, under 35 U.S.C. §119, of Austrian patent application A 218/2012, filed Feb. 21, 2012; the prior applications are herewith incorporated by reference in their entirety.

BACKGROUND OF THE INVENTION

Field of the Invention

The invention relates to a dispensing system having a dispenser and a material web, wound to form a roll, which is disposed on a support bar having bearing journals projecting on both sides that can be inserted into guides on the dispenser. At least one of the two bearing journals is provided with at least one mating surface which is not configured as a rotation surface.

A surface which is not configured as a rotation surface here is understood to be a surface of which the generatrix varies in distance to the axis of the bearing journal. Surfaces which are not configured as a rotation surface above all are planar, if applicable also curved, lateral surfaces of webs or grooves which are provided on end sides on the bearing journals, stepped surfaces and/or a prismatic skin surface on the end of the bearing journal, or the like.

The rolls comprise various material webs which are wound onto cores and/or also wound in a coreless manner and are subsequently equipped with the support bars extending therethrough in order to be able to unroll the material web in a dispenser. This is particularly valid when the rolls are cut from a roll strand, as is the case in general with domestic roll paper, sanitary roll paper, toilet roll paper, etc. Receptacles or guides for rolls of this type in dispensers generally are formed with grooves into which the bearing journals are guided. Since the correct arrangement of the rolls has to be taken into account in order for the end of the material web to always hang down from the roll on the same side, the bearing journals and associated guides on the two sides are configured so as to be different.

In particular in the case of low-value material webs, such as, for example, in the case of domestic paper rolls, toilet paper rolls, other sanitary paper rolls, continuous rolls of refuse bags, or similar, the materials also used for the bearing journals are rather cost-effective and thus display only sufficient stability or strength in order to enable the application. The bearing journals, despite the unequivocal assignment by way of the different design of the two sides, are thus not safe from damage which may be caused by forcible attempts at placing the roll into the dispenser in an incorrect manner.

A support bar of this type and a dispenser into which rolls having the support bar projecting at both sides are inserted are known from my earlier disclosure in European patent application EP 1 927 308 and its counterpart publication US 2008/121750 A1. There, a bearing journal of the support bar has an end flange which is spaced apart from the central region of the support bar by a circumferential groove and which is, on its end side, provided with a groove, the side walls of which in each case represent a mating surface which is not configured as a rotation surface. The end flange of the bearing journal can be slotted into an undercut guide in the side wall of the dispenser, a web-like protrusion being provided at the commencement of the guide that corresponds to the end-side groove in the bearing journal and the side faces of the protrusion thus forming counter surfaces to the mating surfaces of the groove. During insertion the roll and/or the bearing journal, therefore, have to be rotated such that coincidence of the two surfaces is achieved. Only then may the roll be pushed into the dispenser. Since the support bar, in the central region, displays webs which stick out on which the wound material web is held in a rotationally fixed manner, such that the support bar rotates together with the roll when the material web is drawn off, the web-like protrusion terminates far before the dispensing position of the roll and the bearing journals, in the dispensing position of the roll, are able to rotate in an arbitrary manner.

SUMMARY OF THE INVENTION

It is accordingly an object of the invention to provide a dispensing system which further improves the heretofore-known devices of this general type and which provides for simplifications both on the dispenser and on the support bars, without mitigating the given advantages of the dispensing system known from EP 1 927 308 and US 2008/121750 A1.

With the above and other objects in view there is provided, in accordance with the invention, a support bar for a material web wound to form a roll, the support bar comprising:

a respective bearing journal disposed at each end of the support bar, each the bearing journal lying in a longitudinal axis of the support bar;

at least one of the two bearing journals being formed with at least one mating surface, which is not configured as a rotation surface, and which is configured on a groove formed in an end side of the at least one bearing journal, and the at least one bearing journal being rotatably disposed on the support bar.

In accordance with an added feature of the invention, the groove is a dove-tail shaped groove.

With the above and other objects in view there is also provided, in accordance with the invention, a support bar for a material web wound to form a roll, the support bar comprising:

a respective bearing journal disposed at each end of the support bar, each the bearing journal lying in a longitudinal axis of the support bar;

at least one of the two bearing journals being formed with at least one mating surface, which is not configured as a rotation surface, and being rotatably disposed on the support bar; and the support bar having a central region between the two bearing journals, for receiving the material web in a rotationally fixed manner and having wings projecting out from a circumference thereof.

Here, as well, the mating surface may formed on a groove at the end side of the at least one bearing journal and, preferably, the groove may be dove-tail shaped.

In other words, the objects of the invention are achieved according to the invention in the case of a support bar for a material web wound to form a roll, which on each end displays a bearing journal lying in the longitudinal axis of the support bar, wherein at least one of the two bearing journals is provided with at least one mating surface which is not configured as a rotation surface, in that the at least one bearing journal which is provided with the mating surface is rotatably disposed on the support bar.

The object is further achieved in the case of a dispenser having a guide which terminates in a dispensing position, on the commencement of which a counter surface to the mating surface of the bearing journal is provided, in that the at least one bearing journal is rotatably disposed on the support bar and in that the counter surface on the guide extends up into the dispensing position. It is preferably provided here that the guide on the dispenser is formed by a projecting ridge onto which the groove can be pushed.

Other features which are considered as characteristic for the invention are set forth in the appended claims.

Although the invention is illustrated and described herein as embodied in a dispensing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 shows a support bar in the longitudinal section taken along the I-I in FIG. 2, carrying a roll of material in dashed lines;

FIG. 2 shows an end view of the right end of the support bar in FIG. 1,

FIG. 3 shows, in an enlarged manner, the right end of the support bar in FIG. 1.

FIG. 4 shows a schematic illustration of a guide for the support bar in a dispenser, FIG. 5 shows the guide of FIG. 4 in a plan view.

DETAILED DESCRIPTION OF THE INVENTION

Figure 6:
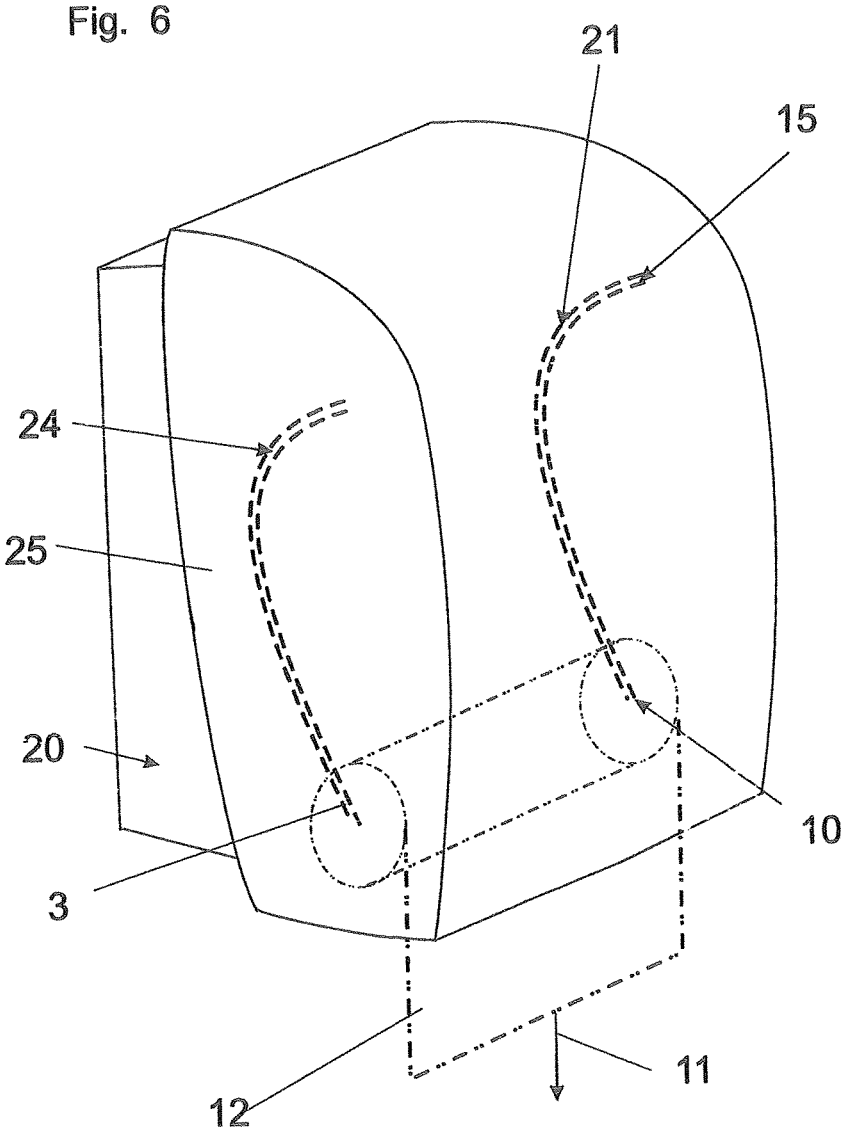
FIG. 6 shows a schematic perspective view of a dispenser equipped with a roll.

Since they are cut from a strand, material webs 12, in particular of domestic roll paper or sanitary roll paper, wound to form rolls 3, in general require bearing journals 4, 5 projecting from the end sides when, after opening a lid 25, they are inserted into guides 21, 24 of a dispenser 20 (FIG. 6) and are rotatably mounted in a dispensing position 10 therein. The bearing journals 4, 5 here are provided on the ends of a support bar 1, wherein in the figures a simple bearing journal 4, having a circular-cylindrical rotation surface, which fits into a groove of a guide 24 of the dispenser 20, is drawn on the left. However, it is in principle also possible for the bearing journal 4 and the guide thereof to be likewise configured as per the possibility described in the following for the bearing journal 5, shown on the right, and the guide 21 thereof.

In order to be able to insert the rolls 3 into the various guides 21, 24 of the dispenser 20 in a positionally correct manner only (i.e., in the proper orientation), such that the material web is always drawn off from the same side of the roll 3 (FIG. 5), the guide 21 is configured as a ridge 22 which projects from the wall of the dispenser 20 and onto which the correspondingly configured region of the bearing journal 5, in the insertion position 15, can be pushed. The bearing journal 5, therefore, on the free end side, has a groove 8 which is configured so as to be conversely disposed to the ridge 22 on the wall of the dispenser 20. The side walls of the groove 8 are mating surfaces 9 which, in contrast to the circumferential surface of the bearing journal 5, do not represent rotation surfaces but which are, in particular, planar, their counter surfaces 2 being provided on the ridge 22.

Figure 3A:
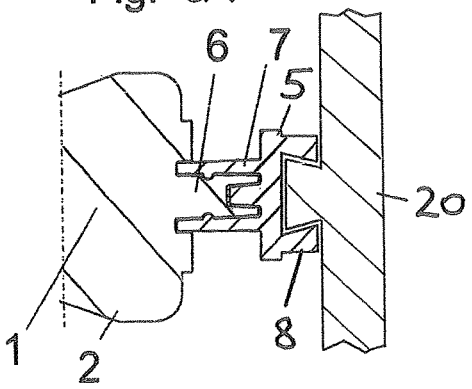
FIG. 3A is a similar view of an alternative embodiment of the right end of the support bar and the sidewall of the dispenser.

FIG. 3A illustrated an alternative embodiment. There, the groove 8 is undercut with an trapezoid cross-section. The ridge 22 on the inside of the sidewall of the dispenser 20 has a corresponding shape that reaches into the groove 8. The ridge 22 and the groove 8 represent a dove-tail connection. The connection allows the bearing journal 5 to slide along the sidewall in a rotationally locked manner (i.e., the shaft of the support bar is rotatably supported on the bearing journal 5) and also held against the sidewall due to the positive (form) lock provided by the dovetail connection.

Since the ridge 22 extends not only in the insertion position 15 on the commencement of the guide 21 but across the entire length thereof up into the dispensing position 10, the roll 3, which in the central region of the support bar 1 is held in a rotationally fixed manner by the wings 2 sticking out there from the circumference, would rotate along in a manner corresponding to the curvature of the guide 21 and remain in a non-rotatable manner in the dispensing position 10, such that the material web 12 cannot be drawn off. In order to make this nevertheless possible in the direction of the arrows 11, the bearing journal 5 is rotatably mounted on the end of the support bar 1, as can be seen from FIGS. 1 and 3. The support bar 1 is provided with a tapered axial end part 6 on which a circumferential channel is provided. To this end, the bearing journal 5 displays a sleeve 7 which is adapted thereto and which is provided with an annular bead, such that, when being attached to the end part 6, the bearing journal 5 is latched. In this manner, as can be seen from FIGS. 4 and 5 the position of the roll 3 and/or of the support bar 1, when being moved from the insertion position 15 (on the right in FIG. 5) into the dispensing position 10 (on the left in FIG. 5), remains unmodified in relation to the dispenser, despite the bearing journal 5 being forced to follow the curvature of the ridge 22, since the bearing journal, on the end part 6 of the support bar 1, can rotate about the corresponding angle. In the dispensing position 10, the support bar 1, with the roll 3, can rotate in and/or on the bearing journal 5 when the material web 12 is drawn off (arrow 11). The support bar 1 and the bearing journal 5 are preferably composed of a cost-effective plastic, wherein dynamic friction which cannot be defined in more detail arises between said support bar 1 and said bearing journal 5, on account of which an advantageous braking effect on the roll 3 is achieved when the material web is drawn off.

The invention claimed is:

1. A support bar for a material web wound to form a coreless roll, the support bar comprising:

a respective bearing journal disposed at each end of the support bar, each said bearing journal lying in a longitudinal axis of the support bar;

at least one of said two bearing journals comprising an axial end of the support bar and a sleeve including at least one mating surface, said at least one mating surface being formed on a groove at an end side of said sleeve, said sleeve being non rotatably fixed, and said support bar rotating relative to said sleeve; and the support bar having a central region between said two bearing journals formed with longitudinal wings projecting out from a circumference thereof, for receiving the material web in a rotationally fixed manner.

2. The support bar according to claim 1, wherein said groove is dove-tail shaped.

3. A roll, comprising a wound material web and a support bar according to claim 1.

4. A dispensing system, comprising:

a dispenser for dispensing portions of a material web wound to form a coreless roll;

a support bar for supporting the roll in said dispenser;

said support bar having a respective bearing journal disposed at each end of the support bar, each said bearing journal lying in a longitudinal axis of the support bar, at least one of said two bearing journals comprising an axial end of the support bar and a sleeve including at least one mating surface, said at least one mating surface being formed in a groove at an end side of said sleeve, said sleeve being non rotatably fixed, and said support bar rotating relative to said sleeve; and a central region between said two bearing journals having longitudinal wings projecting out from a circumference thereof, for receiving and supporting said roll of at least one material web in a rotationally fixed manner;

said dispenser having a guide formed by a projecting ridge terminating in a dispensing position, said guide having a counter surface to mate with said groove of said sleeve when pushed onto said ridge;

wherein an insertion of said roll into said dispenser is possible only when said mating surface and said counter surface coincide.

* * * * *